US005575166A

United States Patent [19]

Michalewski et al.

[11] Patent Number: 5,575,166

[45] Date of Patent: Nov. 19, 1996

[54] HIGH ENERGY IMPACT RIVETING APPARATUS AND METHOD

[75] Inventors: David Michalewski, Cheektowaga; Joseph A. Dionne, West Seneca; Mark A. Siuta, Lockport, all of N.Y.

[73] Assignee: Gemcor Engineering Corp., Buffalo, N.Y.

[21] Appl. No.: 480,811

[22] Filed: Jun. 7, 1995

Related U.S. Application Data

[62] Division of Ser. No. 118,511, Sep. 9, 1993, Pat. No. 5,471,865.

[51] Int. Cl.[6] ..... B21J 7/30; H02K 33/00

[52] U.S. Cl. ..... 72/56; 72/430; 29/243.53

[58] Field of Search ..... 72/56, 430; 29/243.53, 29/243.54

[56] References Cited

U.S. PATENT DOCUMENTS

| | | | |
|---|---|---|---|
| 1,365,664 | 1/1921 | Cox . | |
| 2,083,168 | 6/1937 | Larson . | |
| 2,441,517 | 5/1948 | Sussman . | |
| 3,375,694 | 4/1968 | Pratt | 72/361 |
| 3,453,463 | 7/1969 | Wildi . | |
| 3,584,496 | 6/1971 | Keller | 72/430 |
| 3,783,662 | 1/1974 | Keller et al. | 72/430 |
| 3,811,313 | 5/1974 | Schut | 72/430 |
| 4,862,043 | 8/1989 | Zieve | 72/430 |
| 4,990,805 | 2/1991 | Zieve | 72/430 |

FOREIGN PATENT DOCUMENTS

| | | |
|---|---|---|
| 1503181 | 12/1969 | Germany . |
| 53707 | 3/1989 | Japan . |
| 432953 | 12/1974 | U.S.S.R. . |
| 542580 | 1/1977 | U.S.S.R. . |
| 544495 | 2/1977 | U.S.S.R. . |
| 1333465 | 8/1987 | U.S.S.R. . |
| 1357110 | 12/1987 | U.S.S.R. . |

*Primary Examiner*—David Jones

*Attorney, Agent, or Firm*—Hodgson, Russ, Andrews, Woods & Goodyear LLP

[57] ABSTRACT

A method and apparatus for forming a metal object wherein first and second coils are provided in close proximity to and in electromagnetic association with each other, the first coil is in driving association with a forming tool for forming the metal object and the first and second coils are supported in a manner allowing movement of the first coil relative to the second coil, and wherein an electric current pulse is supplied simultaneously to the first and second coils to produce a repulsive electromagnetic force sufficient to accelerate the first coil and drive the forming tool to perform a forming operation on the metal object, the pulses being shaped in accordance with a characteristic of the object being formed. The pulse shaping aspect includes matching the magnetic force based on the current pulse with the stress-strain characteristic of the object being formed. A voltage doubling network can be employed to provide increased output force. In high energy impact fastener installation apparatus, there is balancing of the applied force from both ends of the fastener during simultaneous impact and upset to eliminate transfer of force to the workpiece and supporting structure.

10 Claims, 7 Drawing Sheets

HIGH ENERGY IMPACT RIVETING APPARATUS AND METHOD

This is a divisional of application Ser. No. 08/118,511 filed on Sep. 9, 1993, now U.S. Pat. No. 5,471,865.

BACKGROUND OF THE INVENTION

This invention relates generally to the metal forming art, and more particularly to a new and improved method and apparatus for forming a metal object such as upsetting a rivet or like fastener.

One area of use of the present invention is in upsetting rivets, slugs and like fasteners in a workpiece, although the principles of the present invention can be variously applied to forming similar metal objects. An early form of high energy impact apparatus of the electromagnetic type for upsetting fasteners utilized the forces exerted upon a conducting surface of an anvil by a pulsed magnetic field to upset a rivet. The conducting surface was a thin copper plate interconnected with an anvil driver and initially located in close proximity to a coil formed from a thin copper plate spiral wound around the flats and typically referred to as a pancake coil. Very high voltage energy storage capacitor banks discharge a high energy current pulse of about 200–500 kiloamperes to the pancake coil creating an intense magnetic field for exerting a force on the anvil to upset the fastener.

An alternative to the foregoing high voltage electromagnetic riveting is a low voltage electromagnetic riveter that relies on eddy current diffusion as described in U.S. Pat. No. 4,862,043. The eddy current diffusion is a function of the magnetic field strength relative to the above-described conducting surface or copper plate. The low voltage approach of U.S. Pat. No. 4,862,043 is characterized by increasing the thickness of the conducting plate sufficient enough to provide the necessary force to upset a fastener such as a rivet. The amount of eddy current diffusion into the conducting plate decreases exponentially with the separation or distance between the coil and plate thus limiting the output force. In order to increase the output force of the coil, it would be necessary to increase the voltage while maintaining the coil geometry. However, the current would increase linearly. The low voltage approach of U.S. Pat. No. 4,862,043 uses 500 volts and approximately 20,000 amperes for an overall efficiency of about 3 percent which reflects the concerns of thermal insulation breakdown, recharging time, and the decaying magnetic field due to coil-plate separation and eddy current diffusion. Furthermore, producing an instantaneous high energy current pulse results in a large potential energy on the coil/anvil assembly which, in turn, can excessively impact the rivet causing unwanted material cracking. In addition, the approach of U. S. Pat. No. 4,862,043 often requires two impacts per rivet to avoid gaps in the workpiece, i.e. one to upset or form the rivet and the other to set the rivet and remove any gaps in the workpiece around the rivet.

It would, therefore, be highly desirable to provide a method and apparatus for forming a metal object such as upsetting a rivet or like fastener which has the advantages of low voltage, decreased heat load, low reactive force to the supporting structure, increased output force, and increased efficiency and which produces a gap-free joint wherein the rivet or like fastener is crack-free.

SUMMARY OF THE INVENTION

It is, therefore, a primary object of this invention to provide a new and improved method and apparatus for forming a metal object such as upsetting a rivet or like fastener.

It is a further object of this invention to provide such a method and apparatus which experiences a relatively lower heat load.

It is a further object of this invention to provide such a method and apparatus which produces increased output force.

It is a further object of this invention to provide such a method and apparatus which has relatively greater efficiency.

It is further object of this invention to provide such a method and apparatus which results in a relatively lower reaction force applied to structure which supports the apparatus and workpiece.

It is a further object of this invention to provide such a method and apparatus wherein the magnetic force is adapted in accordance with a characteristic of the object being formed.

It is a more particular object of this invention to provide such a method and apparatus wherein the magnetic force is tailored to the stress-strain characteristic of the fastener being upset.

It is further object of this invention to provide a gap-free joint in a workpiece containing the object being formed.

It is a more particular object of this invention to provide such a method and apparatus which provides a gap-free joint in a workpiece containing a fastener being upset and in a manner requiring only a single application of force to each fastener.

The present invention provides a method and apparatus for forming a metal object such as upsetting a rivet or like fastener wherein first and second coil means are provided in close proximity to and in electromagnetic association with each other, the first coil means is in driving association with a forming tool adapted for forming the metal object and the first and second coil means are supported in a manner allowing movement of the first coil means relative to the second coil means, and wherein an electric current pulse is supplied simultaneously to the first and second coil means to produce a repulsive electromagnetic force sufficient to accelerate the first coil means and drive the forming tool to perform a forming operation on the metal object, the pulses being shaped in accordance with a characteristic of the object being formed. The pulse shaping aspect of the present invention includes matching the magnetic force based on the current pulse with the stress-strain characteristic of the object being formed. A voltage doubling network can be employed to provide increased output force. In high energy impact fastener installation apparatus according to the present invention, there is balancing of the applied force from both ends of the fastener during simultaneous impact and upset to substantially eliminate transfer of force to the workpiece and supporting structure. Advantages of the method and apparatus of the present invention include low voltage, a relatively less drastic fall off of mutual magnetic field with separation of the two coil means, decreased heat load, increased output force, low reactive force to the supporting structure, increased efficiency, the ability to tailor the magnetic force to synchronize with the force requirements of the metal object during forming, and a gap-free joint containing the object being formed.

The foregoing and additional advantages and characterizing features of the present invention will become clearly apparent upon a reading of the ensuing detailed description together with the included drawing wherein:

BRIEF DESCRIPTION OF THE DRAWING FIGURES

DETAILED DESCRIPTION OF THE ILLUSTRATED EMBODIMENTS

Figure 1:
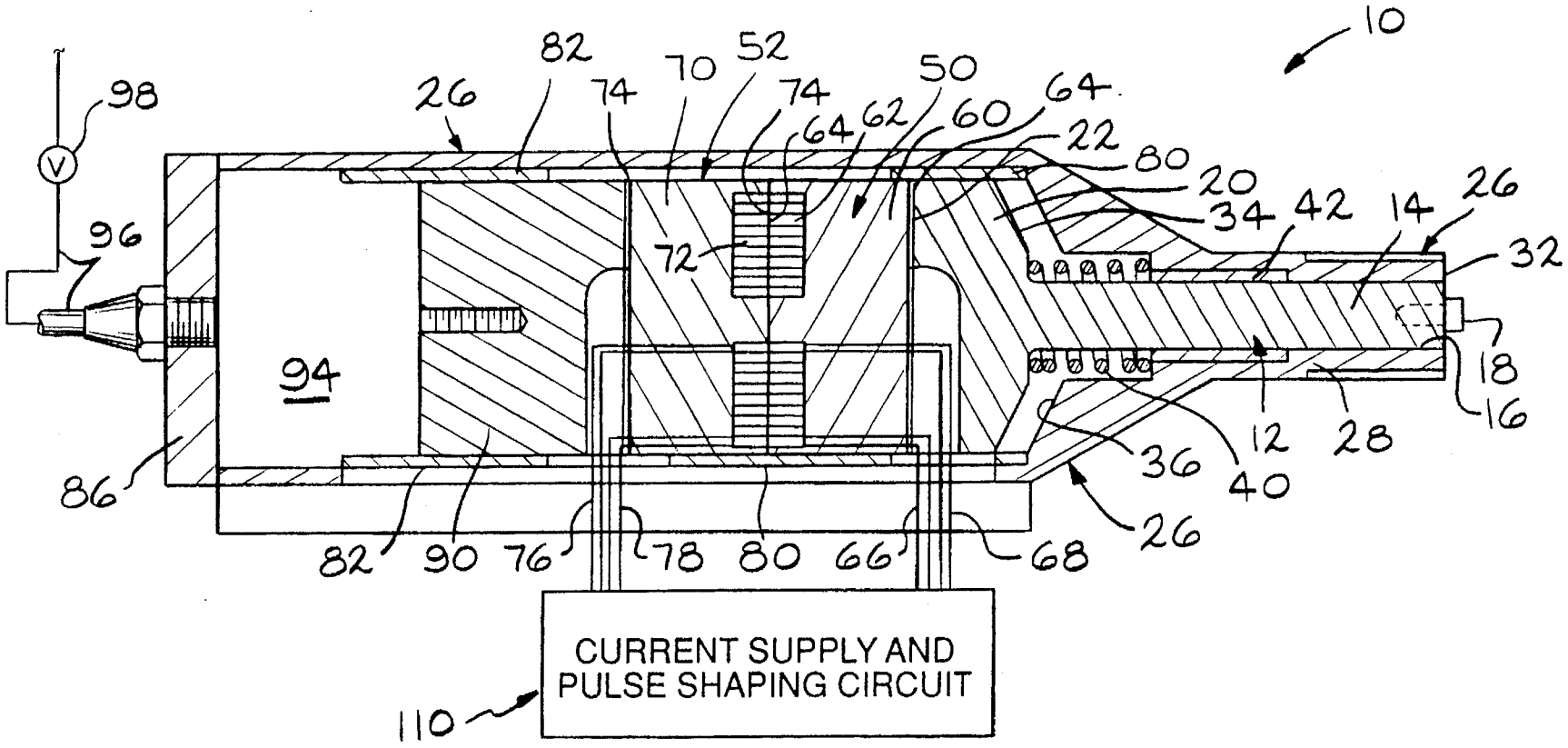
FIG. 1 is a longitudinal sectional view, partly diagrammatic, of electromagnetic metal forming apparatus according to the present invention.

FIGS. 1–5 illustrate a basic method and apparatus according to the present invention for forming a metal object such as upsetting a rivet or like fastener. Referring first to FIG. 1, the apparatus 10 comprises a forming tool generally designated 12 which is adapted for forming the metal object. In the present illustration, tool 12 is in the form of a bucking tool for upsetting a rivet or like fastener and includes an elongated, rod-like body portion 14 which terminates in a flat outer end face 16 into which is fixed a rivet upset button 18. The opposite end of tool 12 includes an enlarged body portion 20 which terminates in a flat end face 22. Tool 12 is movably received in one end of an elongated, generally cylindrical housing 26 which tapers down to a smaller diameter section 28 at the one end which section receives the tool body portion 14. In the initial or rest position of tool 12, the outer and face 16 thereof is substantially flush with an outer annular end face 32 of housing section 28. In operation of the apparatus 10 as will be described, tool 12 is driven forwardly, i.e. to the right as viewed in FIG. 1, until the outer surface 34 of tool body portion 20 abuts or contacts the inner surface portion 36 of housing 26. After that tool 12 is returned to the initial or rest position shown in FIG. 1 by a return spring 40. A sleeve-like guide bearing 42 can be provided between tool body portion 14 and housing section 28 for guiding the movement of tool 12 in housing 10.

The apparatus of the present invention further comprises first and second coil means 50 and 52, respectively, wherein the first coil means 50 is drivingly associated with forming tool 12 and the second coil means 52 is in close proximity to and in electromagnetic association with the first coil means 50. Coil means 50 and 52 both are substantially solid cylindrical in shape having substantially flat axial end faces. Coil means 50 is axially adjacent and in abutting contact with the flat end face 22 of tool 12, and if desired coil means 50 can be fixed to the end of tool 12. Coil means 52 is axially adjacent coil means 50 such that a mutual magnetic field can exist between the two coil means 50 and 52 when they are energized. In the illustrative arrangement shown, the longitudinal axis of housing 10 and the longitudinal axis of coil means 50 and 52 are coincident.

An illustrative form of coil means will be shown in further detail presently. Briefly, coil means 50 as shown in FIG. 1 comprises a substantially cylindrical coil housing 60, a coil winding 62 located in a recess in one axial end face of housing 60, insulating plates or discs 64 on opposite axial end faces of housing 60 and a pair of cables 66, 68 for connecting winding 62 to a circuit for energizing coil means 50 in a manner which will be described. Similarly, coil means 52 comprises a substantially cylindrical coil housing 70, a coil winding 72 located in a recess in one axial end face of housing 70, insulating plates or discs 74 on opposite axial end faces of housing 70 and a pair of cables 76,78 for connecting winding 72 to a circuit for energizing coil means 52 in a manner which will be described. In the illustrative arrangement shown in FIG. 1, coil means 50 and 52 are disposed such that the respective windings 62 and 72 are axially adjacent and hence in optimum mutual electromagnetic association with each other.

Coil means 50 and 52 are supported in and by housing 26 in a manner allowing movement of the first coil means 50 associated with tool 12 relative to the second coil means 52. In the apparatus illustrated in FIG. 1, the movement is in a direction along the common longitudinal axis of housing 26 and of coil means 50 and 52. To accommodate such movement, sleeve-like guide members 80 and 82 can be provided in housing 26 and surrounding portions of the cylindrical peripheral of coil means 50 and 52 as shown in FIG. 1.

The end of housing 26 opposite tool 12, i.e. the left-hand end as viewed in FIG. 1, is closed by a cap or end member 86. A solid cylindrical body in the form of a recoil mass 90 is located in housing 26 axially spaced from end cap 86 and abutting the axial end face of coil means 52. Body 90 is axially movable within housing 26 and is biased in contact with coil means 52 by the supply of pressurized air to the interior region 94 defined in housing 26, the air supply being from a source (not shown) through a line 96 under control of valve 98. The pressurized air in region 94 and recoil mass 90 form a shock absorber for coil means 52 during operation of apparatus 10 to provide a repulsive force between coil means 50 and 52 in a manner which will be described.

Figure 2:
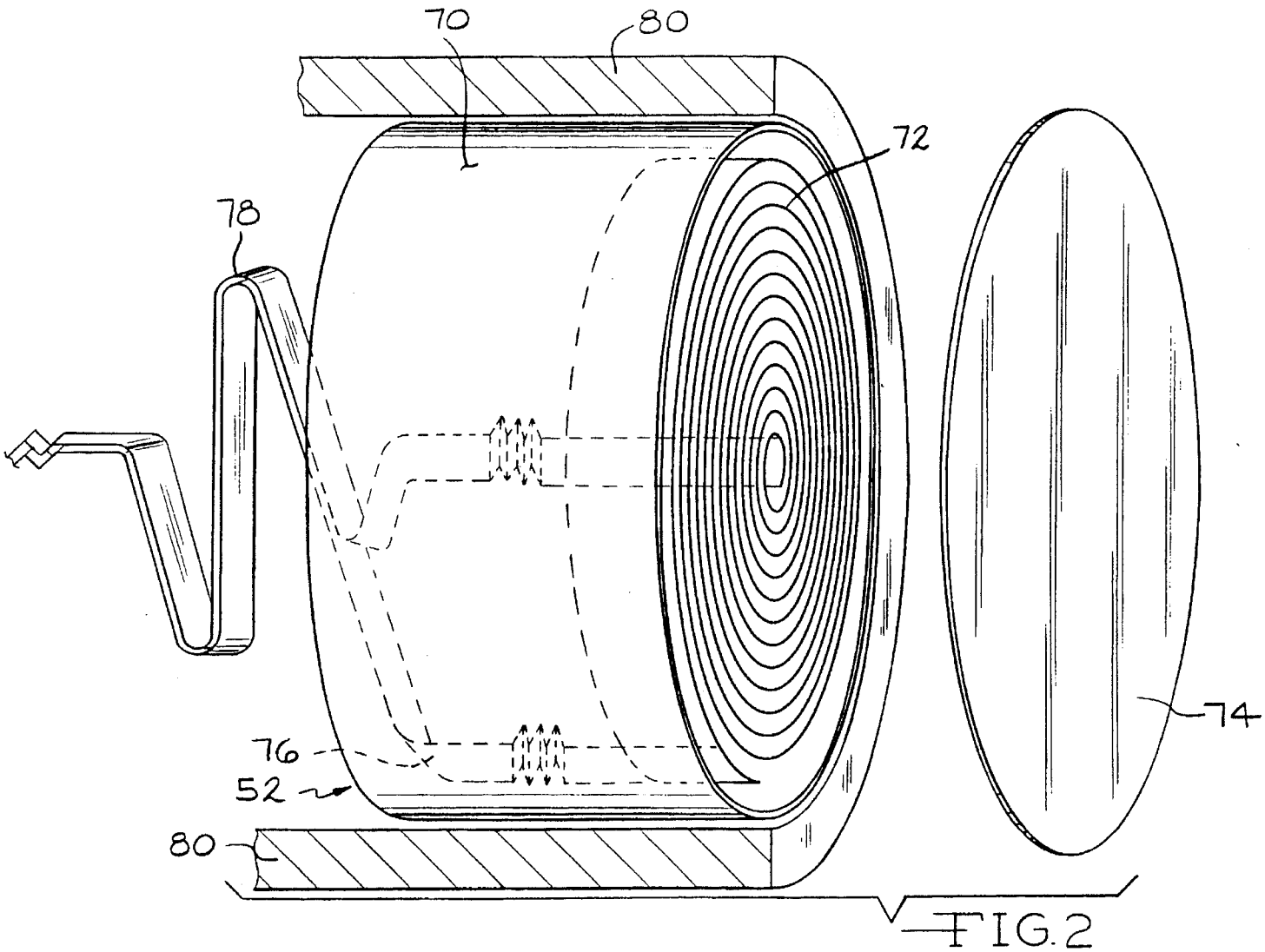
FIG. 2 is an enlarged perspective view of one of the coil means in the apparatus of FIG. 1.

FIG. 2 shows in further detail coil means 52 in the apparatus of FIG. 1, it being understood that coil means 50 is identical in structure. Coil winding 72 can be Nomex insulated wire having a thickness of about 0.02 inch and a width of about 0.5 inch. Coil housing 70 can be of Torlon material which is Teflon material having spiral grooves provided with Kel F material. Cables 76 and 78 are TIG welded otherwise connected to opposite ends of winding 72 as shown. Each insulating plate or disc 74, one of which is shown in FIG. 2, is fixed in place on the corresponding axial end face of housing 70 by suitable means such as epoxy and varnish. Coil means 52 is shown in FIG. 2 within the guide sleeve 80 which can be of non-magnetic stainless steel or aluminum.

The apparatus of the present invention further comprises a circuit generally designated 110 for supplying electric current pulses simultaneously to the first and second coil means 50 and 52 to produce a repulsive electromagnetic force sufficient to accelerate the first coil means 50 and drive the forming tool 12 to perform a forming operation on a metal object. The circuit 110 includes pulse shaping means for shaping the current pulses in accordance with a characteristic of the object being formed. For example, the forming tool 12 can comprise a bucking tool for upsetting a fastener such as a rivet or slug and the pulse shaping means matches the magnetic force based on the current pulse with the stress-strain characteristics of the fastener being upset in a manner which will be described.

Figure 3:
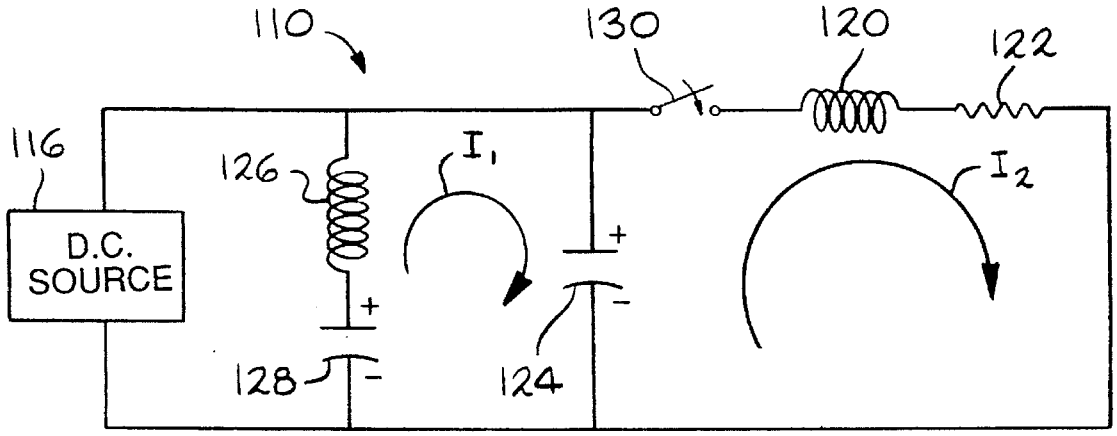
FIG. 3 is a schematic diagram of a form of pulse shaping circuit for use in the apparatus of FIG. 1.

An illustrative form of circuit 110 is shown in FIG. 3 and comprises the combination of a d.c. source 116 and an LC network for forming and shaping current pulses to be supplied to the coils 62 and 72 which are connected electrically in series. The series combination of inductor 120 and resistor 122 in the circuit of FIG. 3 represents the combined inductance and resistance of the two coils 62 and 72. The LC network of the illustrative circuit 110 comprises the parallel combination of a capacitor 124 and inductor 126 and capacitor 128 in series. When switch 130 is open, current flows in the LC network in the direction of loop $I_1$, thereby charging capacitors 124 and 128. When switch 130 is closed, capacitors 124 and 128 are discharged and current flows through coils 62 and 72 in the direction of loop $I_2$. The shape of the current pulse supplied to coils 62 and 72 can be varied by selecting the relative magnitudes of capacitors 124, 128 and inductor 126, the inductor 126 playing the principal role in shaping the current pulse. The pulse shape can be varied further by changing the nature of the LC network, i.e. by adding additional capacitors and inductors in series or parallel with inductor 126 and capacitors 124, 128. D.C. source 116 typically is a rectifier circuit connected to a transformer operated from the a.c. line, and switch 130 typically is a silicon-controlled rectifier.

The apparatus 10 of the present invention operates in the following manner. Tool 12 is positioned in operative relation to a metal object to be formed, for example button 18 is in contact with the head of a rivet (not shown) to be upset in a workpiece. Coil means 50 and 52 are in the initial or rest position shown in FIG. 1. Switch 130 in circuit 110 initially is open allowing capacitors 124, 128 to become charged. Then switch 130 is closed discharging capacitors 124, 128 through coils 62, 72 providing a shaped current pulse through the coils 62, 72 thereby causing a repulsive magnetic force between the first and second coil means 50 and 52 to move coil means 50 relative to coil means 52. In particular, coil means 50 drives tool 12 forwardly with sufficient force to upset the rivet, i.e. to the right as viewed in FIG. 1 and the reaction force on coil means 52 is countered by the force of compressed air in region 94. Then, tool 12 and coil means 50 are returned by spring 40 to the initial or rest position awaiting the next current pulse for the next forming operator. Typically a pair of apparatus units (not shown in FIG. 1) including corresponding electrical circuits are employed, each operatively associated with an end of the elongated fastener or rivet to be upset, which units are operated simultaneously to provide simultaneous impact on the fastener or rivet for upsetting the same.

The method and apparatus of the present invention uses the principle of hard driven magnetic repulsion which is not dependent on eddy current diffusion in any conducting element such as a copper plate. By hard driven is meant the simultaneous energization of the two coils 62, 72 in a motor like fashion with the two coils repelling each other. This is in contrast to a magnet pushing a plate. The mutual magnetic field between the two coils 62, 72 falls off less drastically with coil separation compared to prior art methods and apparatus such as that shown in the above-referenced U.S. Pat. No. 4,862,043. Advantages of the method and apparatus of the present invention include decreased heat load and increased output force due to the increased efficiency since the method is not dependent on eddy current diffusion, and the ability to tailor the magnetic force to synchronize with the force requirements of the metal object during forming. In particular, the LC network of circuit 110 is varied as previous described to match the magnetic force based on the current pulse with the stress-strain characteristics of the fastener being upset.

Figure 4:
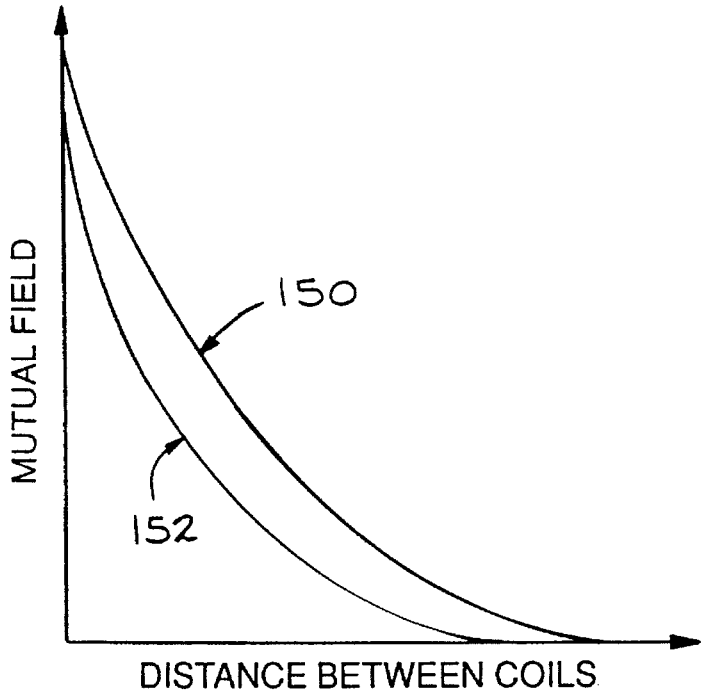
FIG. 4 is a graph including curves illustrating one aspect of operation of the method and apparatus of the present invention in contrast to one prior art approach.

The foregoing is illustrated in further detail by FIG. 4 which includes curves comparing operation of the method and apparatus of the present invention with the prior art approach described in U.S. Pat. No. 4,862,043. In FIG. 4, curve 150 represents the mutual field between coil means 50, 52 as a function of the distance or separation therebetween. Curve 152 represents the mutual field between the coil and plate in the apparatus of U.S. Pat. No. 4,862,043. The mutual field between coil means 50, 52 repelling each other is greater over the distance of coil separation as compared to the mutual field in the apparatus of U.S. Pat. No. 4,862,043. Thus, in the method and apparatus of the present invention, the mutual field is greater when the force is needed, i.e. as coil separation increases, thereby resulting in relatively greater efficiency. Accordingly, the dual coil repulsion approach of the present invention results in a higher mutual field as compared to the eddy current diffusion approach of U.S. Pat. No. 4,862,043.

Figure 5:
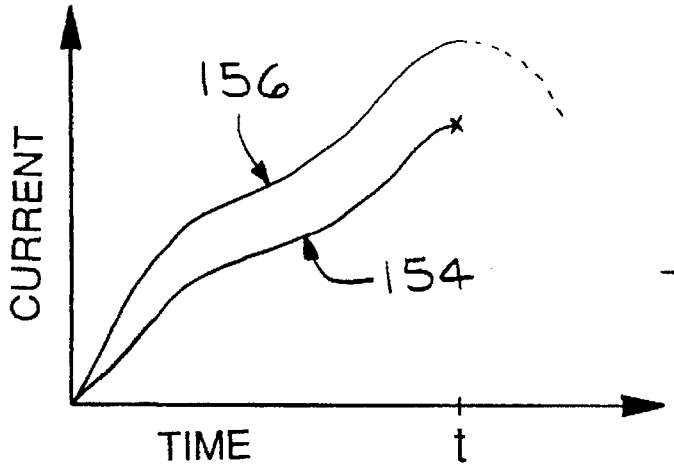
FIG. 5 is a graph including curves illustrating another aspect of operation of the method and apparatus of the present invention.

The present invention is further illustrated by the graph of FIG. 5 wherein curve 154 is the stress-strain curve of the rivet being formed, and the x at the termination of curve 154 represents completion of the rivet forming or upset which typically occurs at a time of about 0.0005–0.003 second. Waveform 156 represents the current pulse formed by the pulse forming network of the present invention. In the dual coil method and apparatus of the present invention, the force output is a function of the current pulse profile. The current pulse profile or shape will determine the net magnetic force acting on the coils 50, 52, anvil 12 and rivet. As shown in FIG. 5, the shape of the current pulse is tailored according to the shape of the stress-strain curve 154 of the rivet so that current is applied as it is needed according to the rivet stress-strain characteristic. Waveform 156 of the tailored current pulse is in sharp contrast to an instantaneous high energy current pulse which will generate a large potential energy on the coil/anvil assembly. Such high potential will excessively impact the rivet causing unwanted material cracking. The rivet has a particular stress-strain deformation curve, for example curve 154 in FIG. 5, in which the maximum force required occurs after plastic deformation has started. The pulse forming network according to the present invention provides a current pulse shape that follows the stress-strain, i.e. deformation, curve of the rivet. The net result of the pulse forming operation is that the generated pulse causes a forming of the rivet in contrast to a mere impacting of the rivet.

Figure 6:
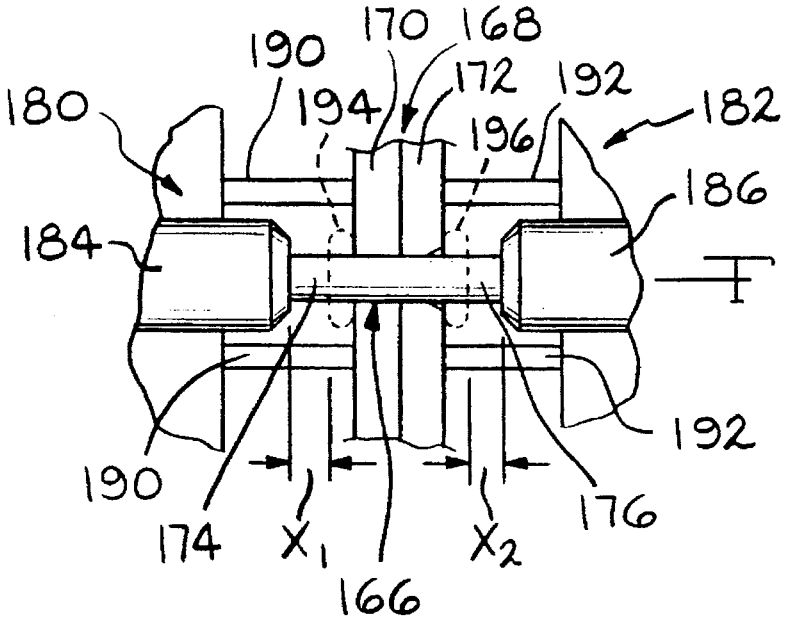
FIG. 6 is a diagrammatic view illustrating use of the apparatus of the present invention for simultaneous impacting the opposite ends of a fastener.

FIG. 6 illustrates use of the apparatus of the present invention in applying simultaneous impact to opposite ends of a fastener 166 for upsetting the same in a workpiece 168 comprising a pair of sheets 170, 172. In the present example fastener 166 comprises a rivet of the type including a tail portion 174 and a head portion 176. It is to be understood, however, that the present invention is equally applicable to applying simultaneous impact to opposite ends of other types of rivets, slugs and similar forms of fasteners for upsetting the same. In the arrangement of FIG. 6, two units of apparatus or riveting guns 180 and 182 are operatively associated with the tail 174 and head 176 of rivet 166, and each riveting gun 180, 182 can be identical to apparatus 10 shown in FIG. 1. In particular, each riveting gun 180, 182 includes a pair of coil means (not shown) one of which is drivingly associated with a forming tool or anvil 184, 186 in a manner similar to forming tool 12 and coil means 50 in apparatus 10. Typically, each riveting gun 180 and 182 will have associated therewith a pressure foot 190 and 192, respectively, or the equivalent for clamping the workpiece 168 in a manner well known to those skilled in the art.

In the application of simultaneous impact to the head 176 and tail 174 of rivet 166 there are a number of objectives to be achieved. One is that during rivet upset there be as little force as possible transferred into the workpiece 168 and the surrounding structure supporting workpiece 168 and riveting guns 180, 182. In other words, during upset there should be low reaction force to the surrounding structure, low workpiece movement, low vibration from impact on the workpiece and supporting structure and no marking on the workpiece from the pressure foot or similar clamping arrangement. There should be proper rivet or fastener formation evidenced by the absence of any cracks in the body of the rivet or fastener and by the absence of any gaps between the workpiece sheets 170, 172 adjacent fastener 166 or gaps between the fastener 166 and the workpiece sheets.

In accordance with the present invention, it has been determined that the foregoing is achieved by balancing the applied force from the head and tail ends of the rivet or fastener during upset, i.e. by having the least possible amount of unbalanced force during simultaneous impact, so that as little force as possible transfers into the rivet panel, i.e. workpiece, and the supporting structure. This force balancing, according to the present invention, is achieved by balancing the respective masses of the apparatus units, i.e. riveting guns, on opposite ends of the fastener, in a manner which will be described in detail presently.

At the conclusion of upset, rivet 166 is deformed to have the formations 194 and 196 shown in dotted lines on the tail and head portions 174 and 176, respectively. Letting x represent the measure or distance of deformation, the foregoing is governed by the relationships:

$$F=Kx=\text{constant}$$

$$F=ma$$

where F is the force applied to the rivet head or tail by the riveting gun, a is the acceleration of the rivet head or tail during deformation, and m is the mass of the apparatus, i.e. the riveting gun, which applies force to the rivet head or tail. The foregoing relationships also can be expressed as follows:

$$F=ma=\frac{m\Delta V}{\Delta t}=\text{constant}$$

where V is the velocity of the rivet head or tail during deformation and $\Delta t$ is the time during which the riveting gun anvil is on the head or tail of the rivet. Considering the simultaneous impacting of the rivet tail 174 and head 176 where $x_1$ is the deformation of the tail and $x_2$ is the deformation of the head as shown in FIG. 6, the law of conservation of momentum applies:

$$\frac{M_1\Delta V_1}{\Delta t_1}=\frac{M_2\Delta V_2}{\Delta t_2}$$

where M, and $M_2$ are the masses of the riveting guns operating on the rivet tail and head, respectively, $\Delta V_1$ and $\Delta V_2$ are the velocity of the rivet tail and head, respectively, during deformation and $\Delta t_1$ and $\Delta t_2$ are the times during which the corresponding riveting gun anvils are on the rivet tail and head, respectively. The times $\Delta t_1$ and $\Delta t_2$ should be equal to achieve proper simultaneous impact. Because of the difference in the deformation of head and tail of the rivet $V_1$ and $V_2$ will be different $$\left(V_1,=\frac{\Delta X_1}{\Delta t_1}\text{, and } V_2=\frac{\Delta X_2}{\Delta t_2}\right).$$

This will be explained in further detail presently. Therefore, according to the present invention, in order to achieve the balancing of applied force at the tail and head ends of the rivet during upset, the masses M, and $M_2$ of the respective rivet guns are adjusted to achieve the proper force and mass balance. Typically this involves selecting the proper mass of the riveting gun anvil. However, other portions of the riveting gun including the coil means associated with the anvil can be adjusted in mass to achieve the desired mass balance and resulting force balance.

Figure 7:
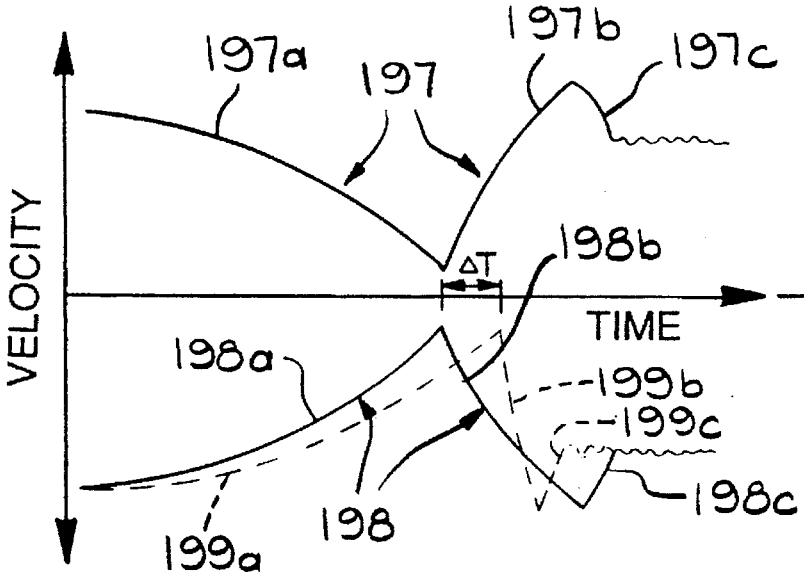
FIG. 7 is a graph including curves illustrating operation of the arrangement of FIG. 6 and the mass balance aspect of the present invention.

The foregoing is illustrated further in the graph of FIG. 7 where curves 197 and 198 represent the velocities of the tail and head portions of the rivet under ideal conditions where no net reaction force is experienced by the workpiece and surrounding structure. In particular, portion **197*a* shows the velocity change from maximum to minimum of the rivet tail portion 174 during impact, portion 197*b* shows the increase in velocity of the rivet tail portion in the opposite direction which occurs immediately after impact followed by a damping of the rivet tail velocity represented by curve portion 197*c*. Similarly, the velocity change of rivet head portion 176 from maximum to minimum during impact is represented by curve portion 198*a*, curve portion 198*b* shows the increase in velocity of the rivet head portion in the opposite direction immediately after impact followed by damping of the rivet head velocity represented by curve portion 198*c*. Under the ideal conditions represented by curves 197 and 198, since portions 197*b*, *c* and 198*b*, *c*** are mirror images of each other occurring at the same time, the associated forces, i.e. reaction forces, in effect cancel out with no net reaction force being experienced by the workpiece and surrounding structure and the energy is concentrated on forming the fastener.

However, under the real conditions associated with simultaneous impacting a headed rivet, deformation of the head portion gives rise to a velocity profile different from that of the tail portion based on the characteristic stiffness of the rivet tail and head. This is apparent in view of the shape and size difference of the rivet head as compared to the tail portion. The broken line curve 199 in FIG. 7 represents the velocity of rivet head portion 176 under actual conditions. It can be seen that the transition between portions **199*a* and 199*b* occurs later in time from the transition between portions 197*a* and 197*b* of the velocity profile of rivet tail portion 174. Curve portion 199*b* representing rivet head velocity after impact and the velocity damping portion 199*c* are not mirror images of portions 197*b* and 197*c*** of the rivet tail velocity profile. Accordingly, this results in a net reaction force being experienced by the workpiece and surrounding structure.

Adjusting the mass of either or both of the riveting heads to achieve the mass balancing and force balancing according to the present invention as described hereinabove has the effect of shifting the velocity profile 199 of rivet head porion 176 by the amount designated ΔT in FIG. 7 so that portions 199*b* and 199*c* substantially coincide in time with and are substantially a mirror image with portions 197*b* and 199*c* of the rivet tail velocity profile so that very little or no net reaction force is applied to the workpiece and surrounding structure. This also has the advantageous result of absence of cracks in the rivet body and no gaps in the riveted joint as discussed hereinabove.

The advantages and characterizing features of the present invention are summarized in the following table which compares the early form of high voltage electromagnetic impact method and apparatus (HVEMR) and the later low voltage approach (LVEMR) with the dual coil method and apparatus of the present invention (DCEMR).

| | HVEMR | LVEMR | DCEMR |
|---|---|---|---|
| Voltage | 10 KV | 500–1200 V | Full range |
| Current | 15–20 KA | 15–40 KA | 10–40 KA |
| Driver | Energy Storage Capacitor Banks | Electrolytic Capacitor Banks | Electrolytic Capacitor Banks |
| Copper Plate | Yes | Yes | No |
| Cu. Plate Thick. | Thin (.08 in) | Thick (.5 in) | None |
| Eddy Current Diffusion | Yes | Yes | No |
| Mutual Mag. Repulsion (MMR) | No | No | Yes |
| Efficiency | Low | Low | Medium |
| MMR vs. Distance | Too fast to Affect | Drops off Rapidly | Holds Relatively Better |
| Number of Coils | One | One | Two |
| Mass Balance | No | No | Yes |
| Rivet Force | Impact | Impact | Impact/Forming |
| Rivet Upset Time | <.0005 Sec. | <.001 Sec. | <.003 Sec. |

Figure 8:
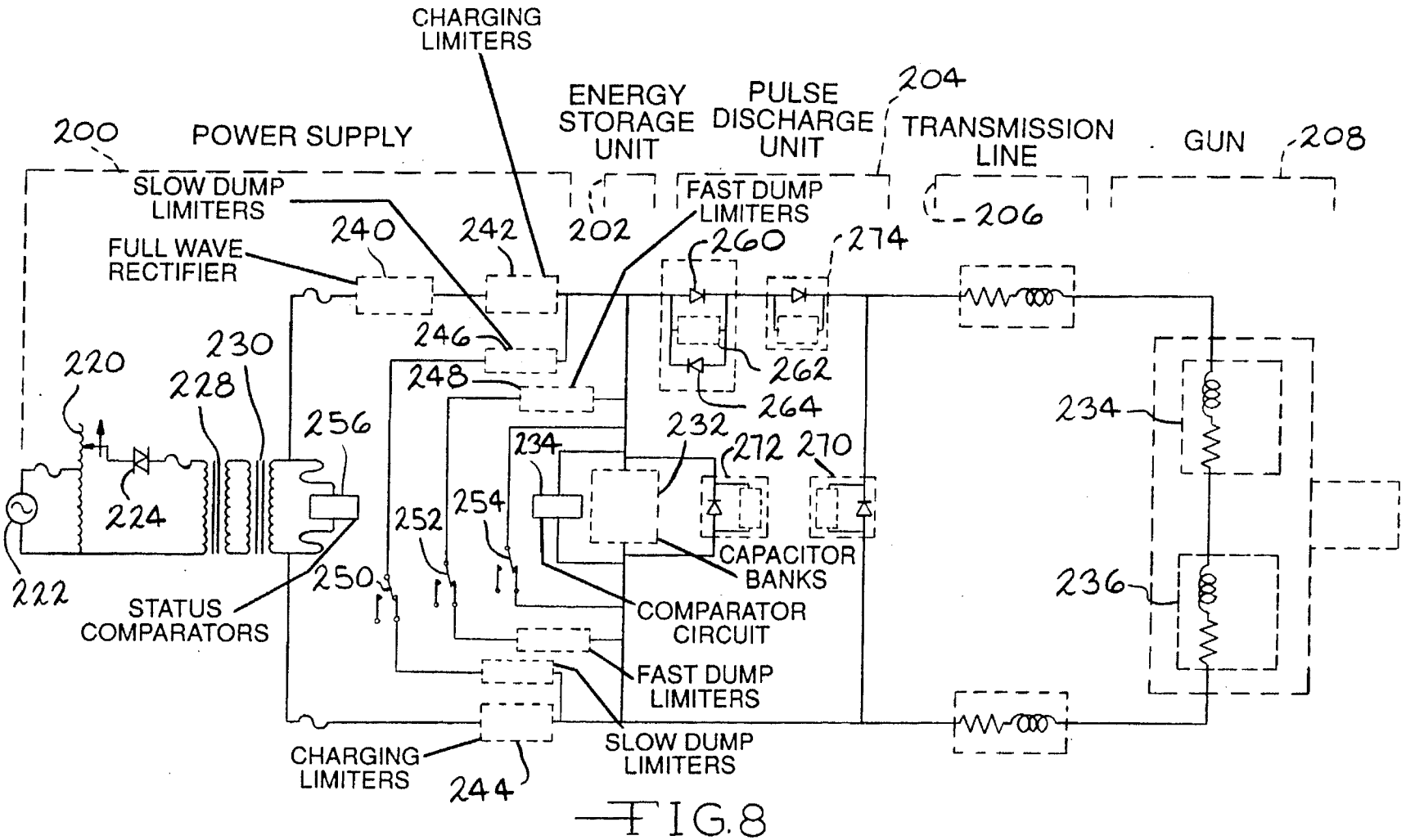
FIG. 8 is a schematic diagram of apparatus according to another embodiment of the present invention.

The present invention is further illustrated by the example of FIG. 8 which is a system for providing about 74,000 lbs. force for upsetting a −18 dia. slug and operating from a low voltage of about 500 volts maximum. The principal system components are power supply 200, energy storage unit 202, pulse discharge unit 204, transmission line 206 and riveting gun 208. Riveting gun 208 is substantially similar to the apparatus of FIG. 1 in that it comprises a pair of axially adjacent coil means within a supporting structure wherein one coil means drives a riveting tool and is movably supported within the apparatus structure so that in response to a current pulse applied to the two coil means a repulsive magnetic force accelerates the one coil means to drive the tool for upsetting the slug (not shown). A form of riveting gun usable in the system of FIG. 8 will be described in detail presently.

Referring first to power supply 200, it performs the various tasks for charging the energy storage unit 202 to the desired voltage and includes various control, voltage transformation, isolation, on/off voltage control logic, voltage rectification, charge limitation and fault protection. Power supply 200 includes a variac 220 connected to the a.c. source 222, i.e., the a.c. power line, for controlling the maximum voltage before transformer step-up. A triac 224 is provided for on/off control of the charging current to provide accurate capacitor voltage in energy storage unit 202. Power supply 200 further comprises the combination of an isolation transformer 228 and a step-up transformer 230. The two separate transformers 228, 230 provide double isolation which enables the capacitors in energy storage unit 202 to be charged at a four second cycle rate.

Triac 224 previously mentioned provides control of the charging current, about 14 amps d.c., in an illustrative system, which is necessary to provide accurate capacitor voltage in the energy storage unit 202. Triac 224, in turn, is controlled by a trigger input applied to the gate thereof and provided by control logic (not shown). The control logic provides the proper interaction between the triac trigger circuit and various other components in the energy storage unit 202 and pulse discharge unit 204. This control logic will be done through a PLC or similar logic controller. The triac trigger will initiate charging of the capacitor banks 232 in unit 202. A comparator circuit 234 will detect when the banks have reached the proper voltage, and a resulting signal will be sent back to the triac trigger which will then cease charging. As the capacitors slowly leak, the comparator circuit 234 will monitor the voltage drop, and again a signal will be sent back to the triac trigger to reinitiate charging, if the voltage drops below the programmed tolerance. This cyclic process will continue until the unit is ready to fire. At this point, the triac trigger will stop charging when the comparator 234 recognizes the correct voltage on the banks. Instantly, an SCR trigger circuit will be activated, and a high energy current pulse will be discharged by the energy storage unit 202 and circulate through the SCR and series connected coils 234, 236 of gun 208. A form of TRIAC trigger circuit will be described in further detail presently.

Comparator circuit 234 can have various forms typically including a combination of operational amplifiers. For example, assuming a capacitor bank including parallel connected capacitors, one end of the combination is connected to a reference or ground and the other end is connected through a series-parallel resistor voltage dropping network to the positive input of a first operational amplifier, for example, an LM341, the output of which is connected to the input thereof. The output of the first amplifier is connected to the positive input of a second operational amplifier, for example an LM341, the output of which is connected to the triac trigger circuit. An appropriate controlled voltage reference, for example, a d.c. source and potentiometer, is connected to the negative input of the second operational amplifier. Other comparator circuits can of course be employed.

The power supply 200 also includes a diode rectifier 240 which provides half-wave rectification, a pair of charge limiters 242, 244 in the form of ceramic power resistors which serve to control capacitor charging time, limit charging current and dissipate power and heat during charging, and safety dump circuits designated 246 and 248. Half-wave rectifier 240 can be replaced by a full-wave rectifier if required by faster charging times. Charge limiters 242, 244 act as a buffer for the high dI/dt values of the diodes required for rectification. Dump circuit 246 provides a soft or slow dump in which the charge limiters 242, 244 are used by dumping the capacitor bank energy from unit 202 through the limiters 242, 244. A slow dump switch 250 is provided so that at any time the capacitors can be bled through the limiters 242, 244. The slow dump allows the capacitor energy to be dissipated slow enough for sampling by comparator 224 and for control to regulate the voltage level on the capacitors of unit 202. Dump circuit 248 under control of switch 252 provides a fast dump characterized by significantly lower resistance and a faster RC discharge through the dump circuit 248. Dump switches can be operated by appropriate control logic to automatically close after a predetermined time lapse to protect equipment operators and maintenance personnel. Switch 254 provides a direct short of the energy storage unit for emergency purposes. A comparator 256 can be connected across the secondary winding of set-up transformer 230 for monitoring the output voltage thereof.

Turning now to energy storage unit 202, it consists primarily of a capacitor bank or series of capacitor banks which are used to store energy delivered from the power supply 200. The energy stored will eventually be discharged from the energy storage unit through the pulse discharge unit 204, transmission line 206, and gun 208. This energy will be in the form of a high energy current pulse, whose duration is on the order of one to five milliseconds. By way of example, in an illustrative system, the capacitors within energy storage unit can comprise aluminum electrolytic capacitors rated at either 0.002 F or 0.003 F and having a charging voltage maximum value of 450 volts. Typically a bank of 10–15 of such capacitors in parallel is employed.

Pulse discharge unit 204 is involved in the process of discharging the capacitor bank in storage unit 202 through the inductive load comprising the series connected coils 234, 236. Unit 204 employs an SCR 260 which is controlled by a trigger circuit or gate drive circuitry (not shown) which is interfaced to control logic in a known manner. A form of SCR trigger circuit will be described in detail presently. Also associated with SCR 260 is a surge absorber or snubber network 262 and a bypass element in the form of diode 264. The snubber network can comprise the combination of a diode in parallel with a resistor and capacitor. By way of example, in an illustrative system, SCR 260 can comprise a high energy, fast recovery, phase controlled and disk-type SCR.

In order to create the desired peak current and force with respect to time, discharge circuit 204 should be underdamped. An underdamped circuit is one in which the total circuit resistance is less than twice the square root of inductance divided by capacitance. Contributing factors include the resistance and inductance of transmission line 206, the capacitance and bus bar inductance of the capacitor bank in unit 202 and the lumped resistance and inductance of coils 234, 236 as shown within the broken line representations of coils 234, 236 in FIG. 8.

In order to generate the force required for extreme applications, the current discharge must reach its peak in a short but controllable amount of time. Thus, the need for an underdamped discharge circuit 204. However, this underdamped circuit is also what is known as a ringing circuit. Ringing occurs because of circuit properties such as inductance, which cause a shift between current and voltage. A resulting problem is that when the voltage drops to zero, the lagging current is still at an extremely high value. Since current still exists in the circuit, the voltage will continue to drop below zero volts. The resulting pattern is for-the voltage and current to ring about the zero axis with a slow, exponential decay.

Accordingly, a wheeling diode 270 inserted across the load serves to create a loop circuit which is "turned on" when the voltage of the capacitor bank reaches zero volts. This causes the wheeling diode 270 to be turned on and as a result, the remaining current is dissipated through the load. A wheeling diode 272 is also inserted across the capacitor bank, as applying a negative potential of more than a few volts across the electrolyrics would destroy them. The wheeling diodes 270, 272 are necessary for operator safety, equipment protection, and providing the desired discharge circuit results. By way of example, in an illustrative system, wheeling diodes 270, 272 can comprise high energy standard recovery rectifier. A diode 274 identical to diodes 270, 272 can be provided in series with SCR 260 to allow the reverse voltage blocking capability to take some of the voltage blocking stress off the SCR. Each of diodes 270, 272 and 274 can be provided with a surge protecting network in parallel therewith and comprising the series combination of a resistor and capacitor.

A preferred form of transmission line 206 is a parallel plate transmission line for conducting the high current capacitor discharge. The sections designated 280, 282 represent the lumped resistance and inductance of the line 206.

An illustrative form of trigger circuit for TRIAC 224 and SCR 260 can include a pulse transformer, the secondary of which is connected through a rectifier to the gate of the SCR and to the gate of the TRIAC. The pulse transformer provides isolation and safe triggering so that no active device such as a transistor directly couples to the SCR or TRIAC which could be turned on accidentally by fast rising voltages. The pulse transformer primary winding is connected to the output of a pulse amplifier and shaping circuit, the input of which is connected to the output of an oscillator. The input to the oscillator is provided by a signal from the system control through an interface circuit which can include an optically coupled transistor. A manually operated switch also can be connected to the interface circuit for manually-initiated triggering when needed. Other forms of trigger circuits can of course be employed.

Figure 9:
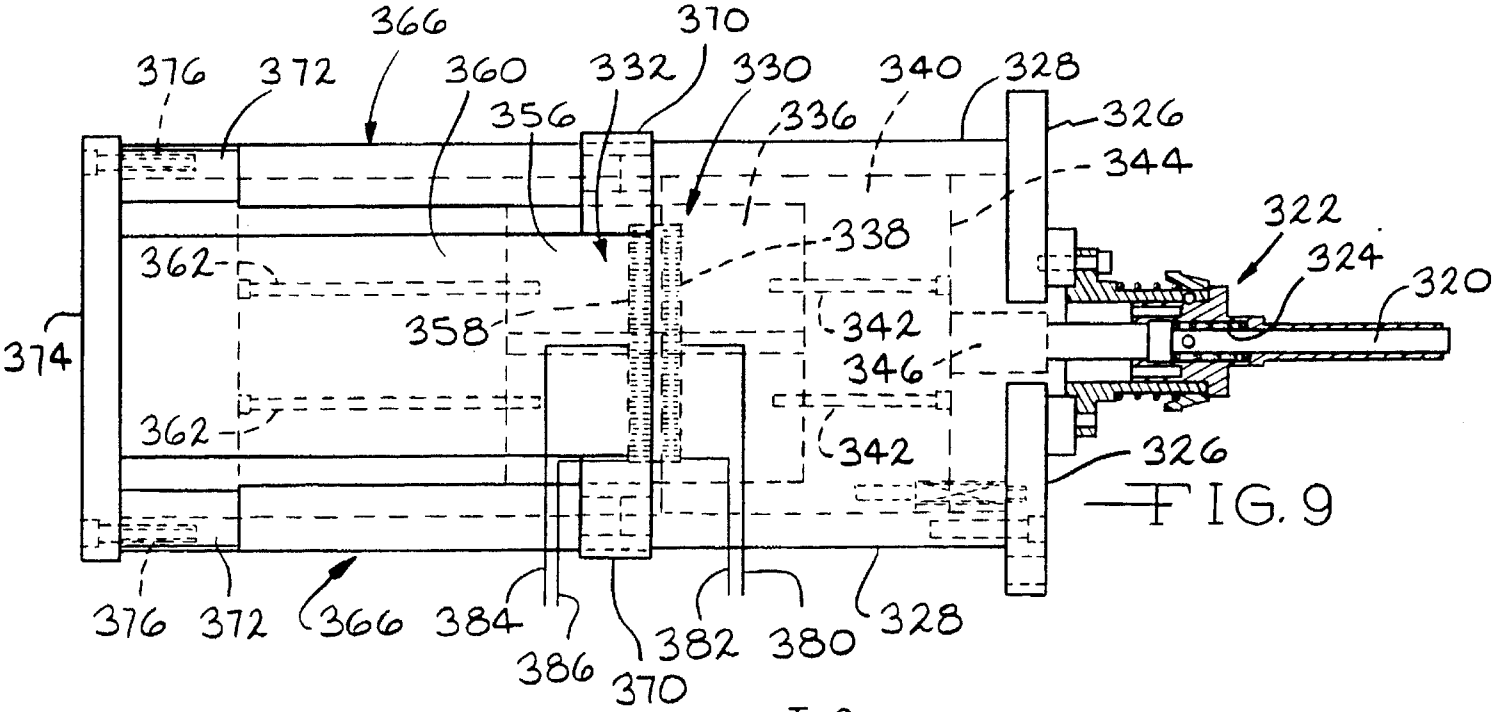
FIG. 9 is a longitudinal sectional view, partly diagrammatic, of the riveting gun in the apparatus of FIG. 8.

A form of riveting gun apparatus 208 for use in the system of FIG. 8 is shown in FIG. 9. A forming tool 320 similar to tool 12 in the apparatus of FIG. 1 is longitudinally movable in a tool adapter assembly generally designated 322 which allows for use of various tools in the apparatus including offset tooling. A spring 324 seated between an inner surface of adapter assembly 322 and an annular shoulder on tool 320 serves to return the tool to its original position after impacting the metal object being formed. Adapter assembly 322 is fixed to a mounting flange 326 which, in turn, is fixed to the end of an elongated housing 328. The apparatus 208 includes first and second coil means 330 and 332, respectively, which are substantially similar to coil means 50 and 52, respectively, in the apparatus of Fig. 1. In particular, coil means 330 comprises a substantially cylindrical housing 336, a coil winding 338 within housing 336 and a cylindrical mass 340 having a recess at one end receiving housing 336, the mass 340 and housing 336 being joined by screws 342 or other suitable fasteners. Mass 340 is slidably received in housing 328, this being facilitated by bearings 344.

Mass 340 has an axial and face 344 provided with a longitudinal extension 346 which abuts the end of tool 320. Thus, upon energization of coil means 330 and 332, coil means 330 is forced to the right as viewed in FIG. 9 to drive tool 320 against the metal object being forced in a manner similar to that of the apparatus of FIG. 1. A spring 350 between mounting flange 326 and mass 340 returns coil means 330 to its original position after impact.

Coil means 332 similarly comprises a substantially cylindrical housing 356, a coil winding 358 within housing 356 and a cylindrical mass 360 having a recess at one end receiving housing 356, the mass 360 and housing 356 being joined by screws 362 or other suitable fasteners. Coil means 330 and 332 are disposed such that the respective windings 338 and 358 are axially adjacent and hence in optimum mutual electromagnetic association with each other. Mass 360 serves as a large recoil mass during operation of the apparatus. There is provided a plurality of shock absorbers generally designated 336 which serve to absorb the recoil force and return coil means 332 to its initial position. Shock absorbers 366 are fixed at one end via fittings 370 to coil means 332 and are connected to rods 372 fixed to an end plate or member 374 secured to the opposite end of housing 328 by screws 376 or other suitable fasteners.

A pair of low resistance transmission lines 380, 382 connects coil winding 338 to the pulse discharge circuit for energizing coil means 330. Similarly, a pair of low resistance transmission lines 384, 386 connects winding 358 to the pulse discharge circuit for energizing coil means 332. The riveting gun apparatus of FIG. 9 operates in a manner similar to that of the apparatus of FIG. 1. The energy storage circuit and pulse discharge circuit provide a current pulse through coils 338, 358 thereby causing a repulsive magnetic force between the first and second coil means 330, 332. Coil means 330 drives tool 320 forwardly with sufficient force to upset the rivet, i.e. to the right as viewed in FIG. 9, and the reaction force on coil means 332 is countered by mass 360 and shock absorbers 366.

Typically a pair of riveting guns of the type shown in FIG. 9 are employed, each operatively associated with an end of the elongated fastener or rivet to be upset, which guns are operated simultaneously to provide simultaneous impact on the fastener or rivet for upsetting the same. The forming tools 320 of each of the guns can be sized to meet the mass balance criteria according to the present invention as described hereinabove.

Figure 10:
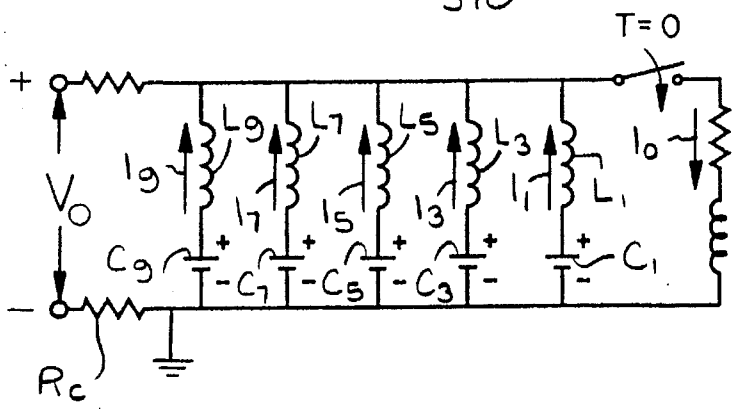
FIG. 10 is a schematic diagram of an alternative form of pulse forming network.

FIG. 10 shows another form of pulse forming network as an alternative to the circuit of FIG. 3. The network includes in this illustration five parallel branches each including a capacitor $C_1$, $C_3$, $C_5$, $C_7$ and $C_9$ in series with an inductor $L_1$, $L_3$, $L_5$, $L_7$ and $L_9$. Resistor R and inductor L represent the lumped resistance and capacitance of the two coil means. Resistors Rc are charging resistors which determine the rate of charge and protect the charging network, i.e. Rc>>R. Vo is direct voltage from an appropriate source, and switch S represents an SCR. The inductors $L_1$, $L_5$, $L_7$ and $L_9$ determine the shape of the current pulse supplied to the coil means.

Figure 11:
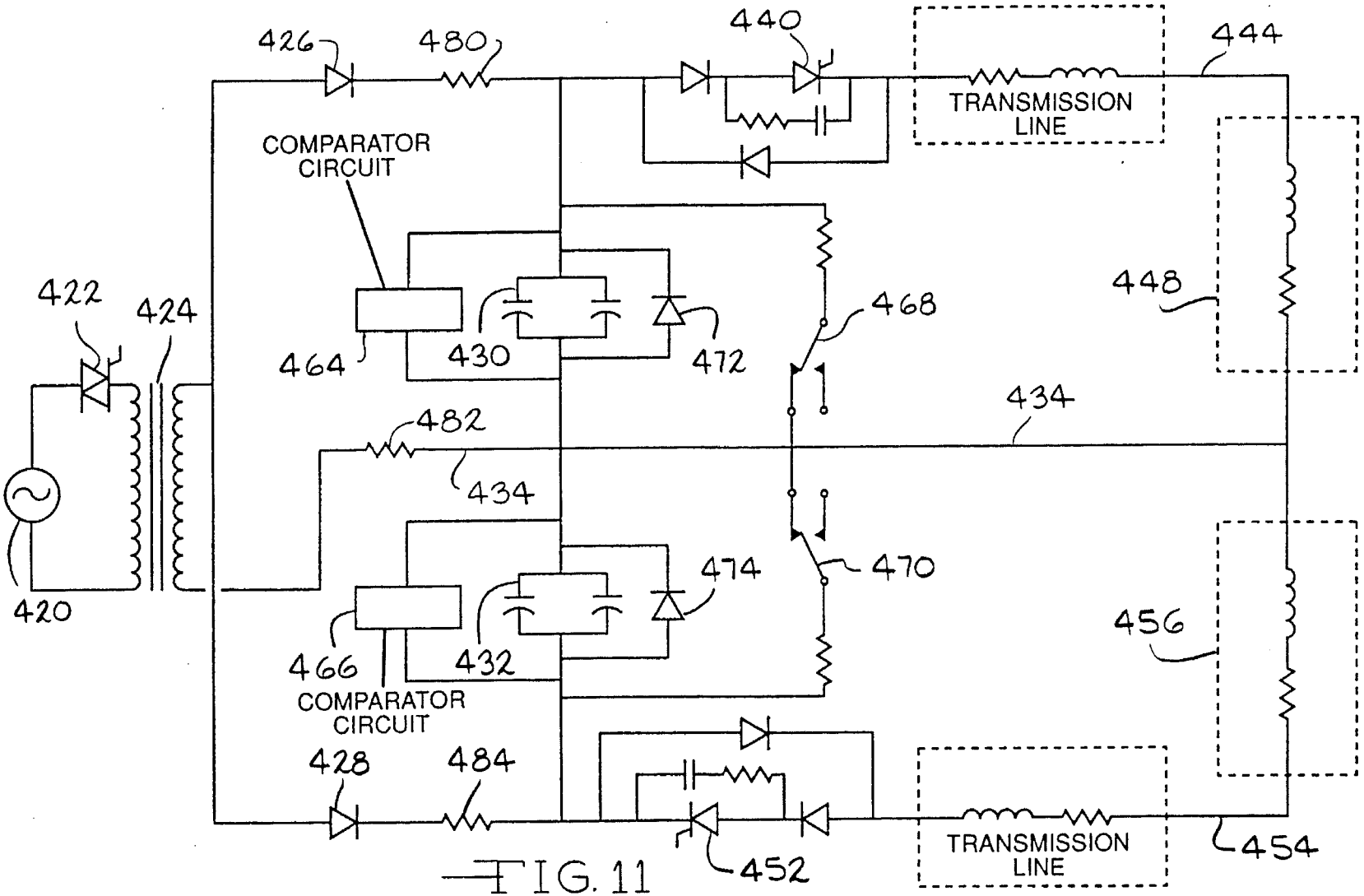
FIG. 11 is a schematic diagram of a voltage doubler circuit for use in the apparatus of the present invention.

FIG. 11 illustrates a form of voltage doubler network for use in the apparatus of the present invention to provide increased output force. An a.c. source 420, TRIAC 422 and transformer 424 are provided as in the circuit of FIG. 8. The circuit includes a pair of diodes 426, 428 connected to provide full-wave rectification. One terminal of the secondary winding of transformer 424 is connected to the anode of diode 426 and to the cathode of diode 428. The circuit includes a pair of capacitor banks or pulse forming networks 430 and 432, each connected between a corresponding one of the diode rectifiers 426, 428 and a line 434 connected to the other terminal of the transformer secondary winding. The circuit also includes a first SCR 440 connected between diode rectifier 426 and transmission line 444 to the one coil means 448 and a second SCR 452 connected between diode rectifier 428 and transmission line 454 connected to the other coil means 456. The junction of the two coil means 448 and 456 is connected by line 434 to the terminal of the secondary winding of transformer 424. Each capacitor bank 430 and 432 has a corresponding comparator circuit 464 and 466, respectively, and a corresponding dump circuit 468 and 470, respectively, each comprising a dump resistor network and relay. Wheeling diodes 472 and 474 are connected across capacitor banks 430 and 432, respectively. The comparators, dump circuits and wheeling diodes in the voltage doubler circuit of FIG. 11 function in a manner similar to the comparators, dump circuits and wheeling diodes in the circuit of FIG. 8.

It is therefore apparent that the present invention accomplishes its intended objects. While embodiments of the present invention have been described in detail, that is for the purpose of illustration, not limitation.

What is claimed is:

1. A method for forming a metal object such as upsetting a fastener comprising the steps of:

a) providing a forming tool adapted for forming said metal object;

b) providing first and second coil means in close proximity to and in electromagnetic association with each other, said first coil means being in driving association with said forming tool;

c) supporting said first and second coil means in a manner allowing movement of said first coil means relative to said second coil means; and d) supplying electric current pulses simultaneously to said first and second coil means to produce a repulsive electromagnetic force sufficient to accelerate said first coil means and drive said forming tool to perform a forming operation on said metal object;

e) said step of supplying electric current pulses including shaping said pulses in accordance with a characteristic of the object being formed.

2. The method of claim 1, wherein said step of shaping said pulses includes matching the magnetic force based on the current pulse with the stress-strain characteristics of the object being formed.

3. The method of claim 1, wherein said electric current pulses are supplied utilizing an LC network and wherein said step of shaping said pulses includes varying at least one parameter of said LC network.

4. Apparatus for forming a metal object such as upsetting a fastener comprising:

a) a forming tool;

b) a first coil means drivingly associated with said forming tool;

c) a second coil means in close proximity to and in electromagnetic association with said first coil means;

d) means for supporting said first and second coil means in a manner allowing movement of said first coil means relative to said second coil means; and e) a circuit for supplying electric current pulses simultaneously to said first and second coil means to produce a repulsive electromagnetic force sufficient to accelerate said first coil means and drive said forming tool to perform a forming operation on said metal object, said circuit including pulse shaping means for shaping said current pulses in accordance with a characteristic of the object being formed.

5. Apparatus according to claim 4, wherein said forming tool comprises a bucking tool for upsetting a fastener such as a rivet or slug and wherein said pulse shaping means matches the magnetic force based on the current pulse with the stress-strain characteristics of the fastener being upset.

6. Apparatus according to claim 4, wherein said pulse shaping means comprises an LC type network.

7. Apparatus for forming a metal object such as upsetting a fastener comprising:

(a) a forming tool;

(b) a first coil means drivingly associated with said forming tool;

(c) a second coil means in close proximity to and in electromagnetic association with said first coil means;

(d) means for supporting said first and second coil means in a manner allowing movement of said first coil means relative to said second coil means; and (e) means for supplying electric current pulses simultaneously to said first and second coil means to produce a repulsive electromagnetic force sufficient to accelerate said first coil means and drive said forming tool to perform a forming operation on said metal object, said pulse supplying means comprising energy storage means and discharge circuit means for discharging said energy storage means in a controlled manner for supplying said current pulses to said coils, said discharge circuit means further including protective diode means for directing the flow of reverse current and protecting components of said discharge circuit means associated therewith.

8. Apparatus according to claim 7, further including protective dump circuit means operatively connected to said energy storage means.

9. Apparatus for forming a metal object such as upsetting a fastener comprising:

(a) a forming tool;

(b) a first coil means drivingly associated with said forming tool;

(c) a second coil means in close proximity to and in electromagnetic association with said first coil means;

(d) means for supporting said first and second coil means in a manner allowing movement of said first coil means relative to said second coil means; and (e) means for supplying electric current pulses simultaneously to said first and second coil means to produce a repulsive electromagnetic force sufficient to accelerate said first coil means and drive said forming tool to perform a forming operation on said metal object, said pulse supplying means comprising energy storage means and discharge circuit means for discharging said energy storage means in a controlled manner for supplying said current pulses to said coils, said pulse supplying means including voltage doubler means so that said first coil means and said forming tool apply increased force to said metal object during forming of the same.

10. Apparatus according to claim 9, wherein said voltage doubler means comprises another energy storage means and discharge circuit means together with full wave rectifier means.

* * * * *